US005741444A

United States Patent [19]

Kasuli

[11] Patent Number: 5,741,444

[45] Date of Patent: Apr. 21, 1998

[54] HUMIDOR AND METHOD

[75] Inventor: Richard A. Kasuli, Ridgefield, Conn.

[73] Assignee: Humicon Corporation, Merrick, N.Y.

[21] Appl. No.: 712,330

[22] Filed: Sep. 11, 1996

Related U.S. Application Data

[60] Provisional application No. 60/004,035, Sep. 20, 1995.

[51] Int. Cl.[6] ..... B01F 3/04

[52] U.S. Cl. ..... 261/128; 261/142; 261/130; 261/131; 392/387; 392/403; 312/31

[58] Field of Search ..... 261/142, 128, 261/130, 131; 392/387, 403; 312/31, 31.01

[56] References Cited

U.S. PATENT DOCUMENTS

| | | | |
|---|---|---|---|
| 2,639,958 | 5/1953 | Stephenson | 312/31 |
| 2,721,252 | 10/1955 | Dorsak | 392/403 |
| 2,753,164 | 7/1956 | Miller | 312/31 |
| 2,821,449 | 1/1958 | Miller, Jr. | 312/31 |
| 3,660,635 | 5/1972 | Liebert | 392/387 |
| 4,028,444 | 6/1977 | Brown et al. | 261/142 |
| 4,711,294 | 12/1987 | Jacobs et al. | 261/142 |

*Primary Examiner*—Tim R. Miles

*Attorney, Agent, or Firm*—St. Onge Steward Johnston & Reens LLC

[57] ABSTRACT

A humidor and method for high humidity, ambient temperature storage of items includes a water reservoir with a relatively large surface area which is gradually and uniformly heated in response to a humidity sensor. The temperature in the reservoir is raised at a rate of less than 1 degree Fahrenheit per 4 minutes to a maintained temperature of less than 5 degrees F. above ambient temperature until a desired humidity level is reached. The humidor enclosure includes convection heating elements which create a convection current between air inlets and outlets to draw fresh air into the humidor. A water level sensor in the water reservoir deactivates the reservoir heater and convection heating elements when the water level drops below a minimum level and simultaneously actives a water level low warning signal.

23 Claims, 8 Drawing Sheets

HUMIDOR AND METHOD

Priority for this application is claimed based on U.S. Provisional application Ser. No. 60/004,035, filed Sep. 20, 1995.

TECHNICAL FIELD

This invention relates to environmentally-controlled storage of perishable items, and in particular, to the storage of cigars and other tobacco products in humidity and temperature controlled enclosures.

BACKGROUND ART

In order to properly store tobacco products, and cigars in particular, the tobacco must be stored in a relatively high humidity environment at or near room temperature. Deviations from these conditions can have detrimental effects on tobacco products. For example, if a cigar is allowed to dry during storage, it will smoke too hot, too fast and will burn unevenly. On the other hand, if a cigar is too moist, it will be difficult to light and it will be difficult to draw air through the cigar.

The optimum temperature for the storage of cigars is 72 degrees Fahrenheit (F.) and the optimum humidity level is approximately 77 percent. While the rooms in which cigars are typically stored are usually within an acceptable range of the desired optimum temperature of 72 degrees F. (especially rooms in which the air is artificially conditioned), the humidity levels of those rooms are very often not within an acceptable range of the optimum level of 77 percent. Ambient humidity in a heated room can typically vary widely between 10 and 50 percent, and in airconditioned rooms, the ambient humidity can be as low as 30 percent. Therefore, typically the temperature for proper storage of cigars will be provided by another source, such as a home or building heating/air conditioning system. In these cases, the ambient air temperature need not be changed for the proper storage of cigars. However, in almost all cases it is necessary to control (and increase) the humidity level for the proper storage of cigars.

A common way to maintain the proper conditions for the storage of tobacco is with the use of an enclosure within which the humidity and possibly the temperature are controlled. The purpose of such enclosures (also known has humidors) is to maintain the humidity level at or near 77 percent while simultaneously maintaining the temperature within the humidor at or near ambient temperature e.g., 65°–75° F.

One example of a past humidor design is an enclosure within which air is forced over the surface of room-temperature water. After passing over the water, the air is circulated within the storage area and among the cigars. While this device does increase the humidity level of the air inside the humidor somewhat, the air does not reach the necessary level of humidity. This is undesirable because tobacco products stored in this manner will dry out resulting in the detrimental effects described above.

Another example of a humidor design includes a small reservoir which is periodically filled with water and heated to a high temperature to produce steam. The hot steam rises from the reservoir and is circulated throughout the storage chamber to maintain the proper level of humidity. While this device effectively increases the humidity within the humidor, it also significantly increases the temperature of the storage area above the optimum temperature. The temperature increase can be detrimental to cigars because at elevated temperatures dormant cigar worm eggs can hatch and eat holes in the cigars. Moreover, the heating process causes cyclical temperature fluctuations within the humidor which are also detrimental to cigars.

What is desired therefore is a device and method for the proper storage of cigars, tobacco products and other perishable items which maintains the proper level of humidity without significantly affecting the temperature within the storage area.

DISCLOSURE OF THE INVENTION

Accordingly, it is an object of the invention to provide a humidor in which the humidity may be maintained at a high level without significantly affecting the temperature within the humidor.

It is another object of the invention to provide a humidor with the above character having a base and a water reservoir which covers the majority of the interior bottom surface of the base of the humidor.

It is yet another object of the invention to provide a humidor with the above character having a means to heat the water reservoir in a gradual and uniform manner to increase the rate of evaporation of the water and to thereby increase the level of humidity in the humidor without affecting the temperature of the air within the humidor.

It is still another object of the invention to provide a humidor with the above character having a heater attached below the water reservoir wherein the heater includes heating elements disposed substantially evenly over a majority of the surface area of the underside of the water reservoir.

It is a further object of the invention to provide a humidor with the above character having a means to sense the level of humidity in the humidor and to energize the heater attached to the reservoir when the humidity level drops below a desired level.

It is yet still another object of the invention to provide a humidor with the above character having a means to exchange the air within the enclosure with fresh air from outside the humidor to prevent the commingling of aromas within the humidor.

It is yet a further object of the invention to provide a humidor with the above character having air inlets along the bottom, air outlets along the top, heating elements adjacent the air outlets and a shroud partially enclosing the heating elements to minimize the heating of the interior of the humidor and for directing heated air out of the air outlets thereby creating a convection current within the humidor.

It is yet another object of the invention to provide an automatic shut-off feature which additionally provides an emergency backup.

It is another object of the invention to provide a humidor with the above character having a water level sensor in the water reservoir to, when the water level is low, de-energize the water reservoir heater and the convection heating elements and to energize a water level low warning signal.

These and other objects are achieved by the present invention, which provides a humidor with a water reservoir within the humidor where the reservoir which covers the majority of the interior bottom surface of the humidor. The water reservoir is heated by heating elements disposed substantially uniformly over the majority of the underside of the water reservoir. A humidity sensor energizes the heating elements when the humidity level drops below a desired level to gradually and uniformly raise the temperature (and thus evaporation rate) of the water in the reservoir by less than 5 degrees F. above ambient temperature. The temperature of the water need not be raised more than a few degrees above ambient temperature because of the relatively large evaporative surface area of reservoir. When the desired humidity level is attained, the humidity sensor de-energizes the heating elements and the water cools to ambient temperature.

The humidor may also include air inlets along the bottom of the humidor, air outlets above the air inlets, convection heating elements adjacent the air outlets, and a shroud partially enclosing the air outlets and convection heating elements. The convection heating elements serve to heat the air within the shroud which causes the air to escape through the air outlets drawing fresh air through the inlets. The shroud also serves to direct heated air through the air outlets and to prevent radiant and convective heating of the interior of the humidor.

A water level sensor in the water reservoir de-activates the reservoir heater and convection heating elements when the water level drops below a minimum level and simultaneously actives a water level low warning signal. These and other preferred aspects of the invention are described in more detail below.

BRIEF EXPLANATION OF THE FIGURES

The invention will be better understood and its advantages will be better appreciated from the following detailed description, especially when read in light of the accompanying drawings, wherein.

BEST MODES FOR CARRYING OUT THE INVENTION

Figure 1:
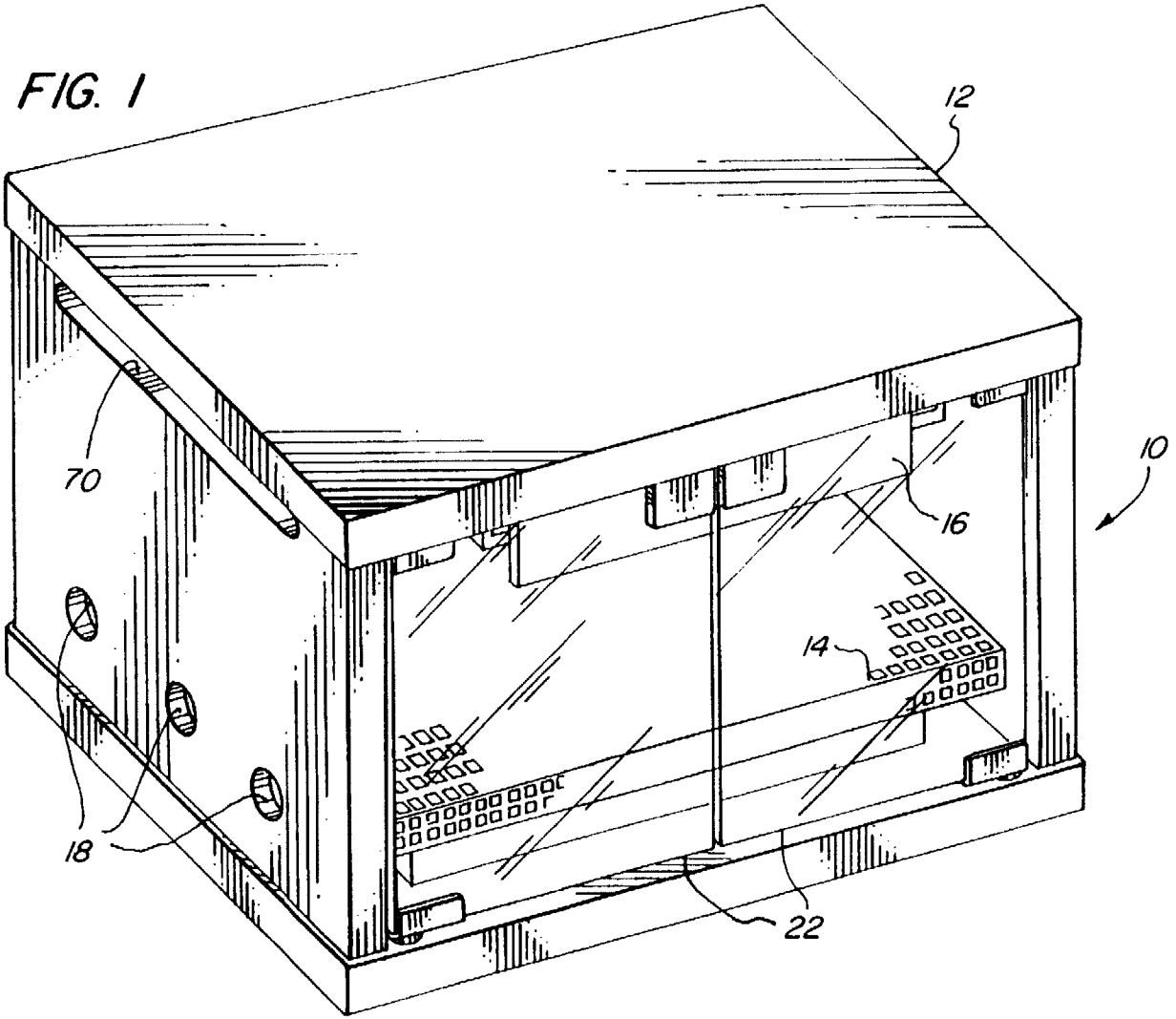
FIG. 1 is an isometric view of the humidor of the present invention.

Referring to FIG. 1, the humidor 10 of the present invention consists of an enclosure 12 for the storage of perishable items such as tobaccos products. Humidors, such as humidor 10 depicted, are typically sized to fit on a shelf or bureau, however, humidor 10 may also be of a larger size and/or may be free standing. Items may be stored in bulk in humidor 10 on a shelf 14 (which is preferably perforated.) Other items (such as single cigars) may be stored individually in sliding drawer 16. As will be further discussed below, humidor 10 may include air inlets 18 and air outlets 20 through enclosure 12 for refreshing the air inside humidor 10. Humidor 10 may also include doors 22.

Figure 2:
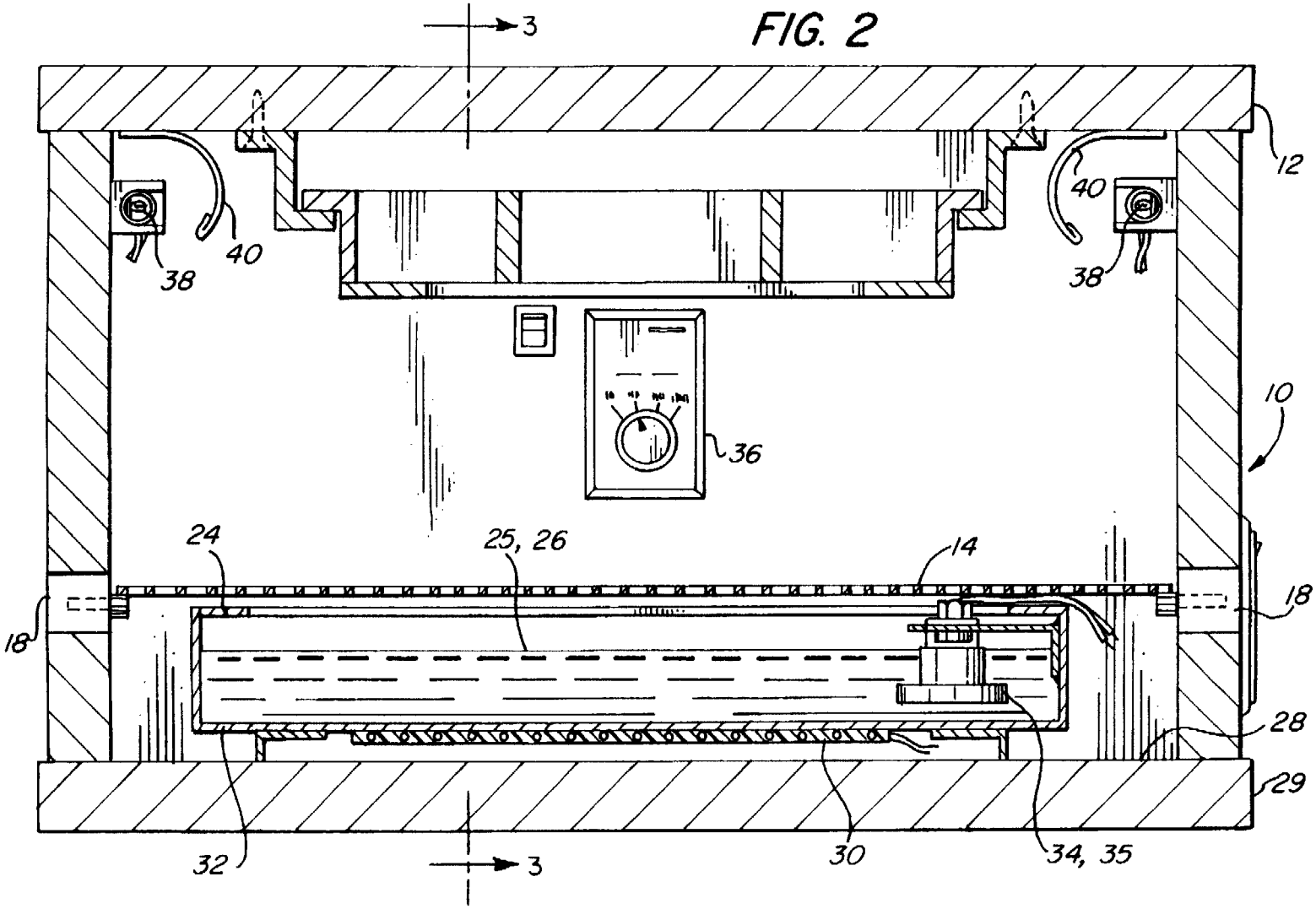
FIG. 2 is a front cross-sectional view of the humidor of FIG. 1.
Figure 3:
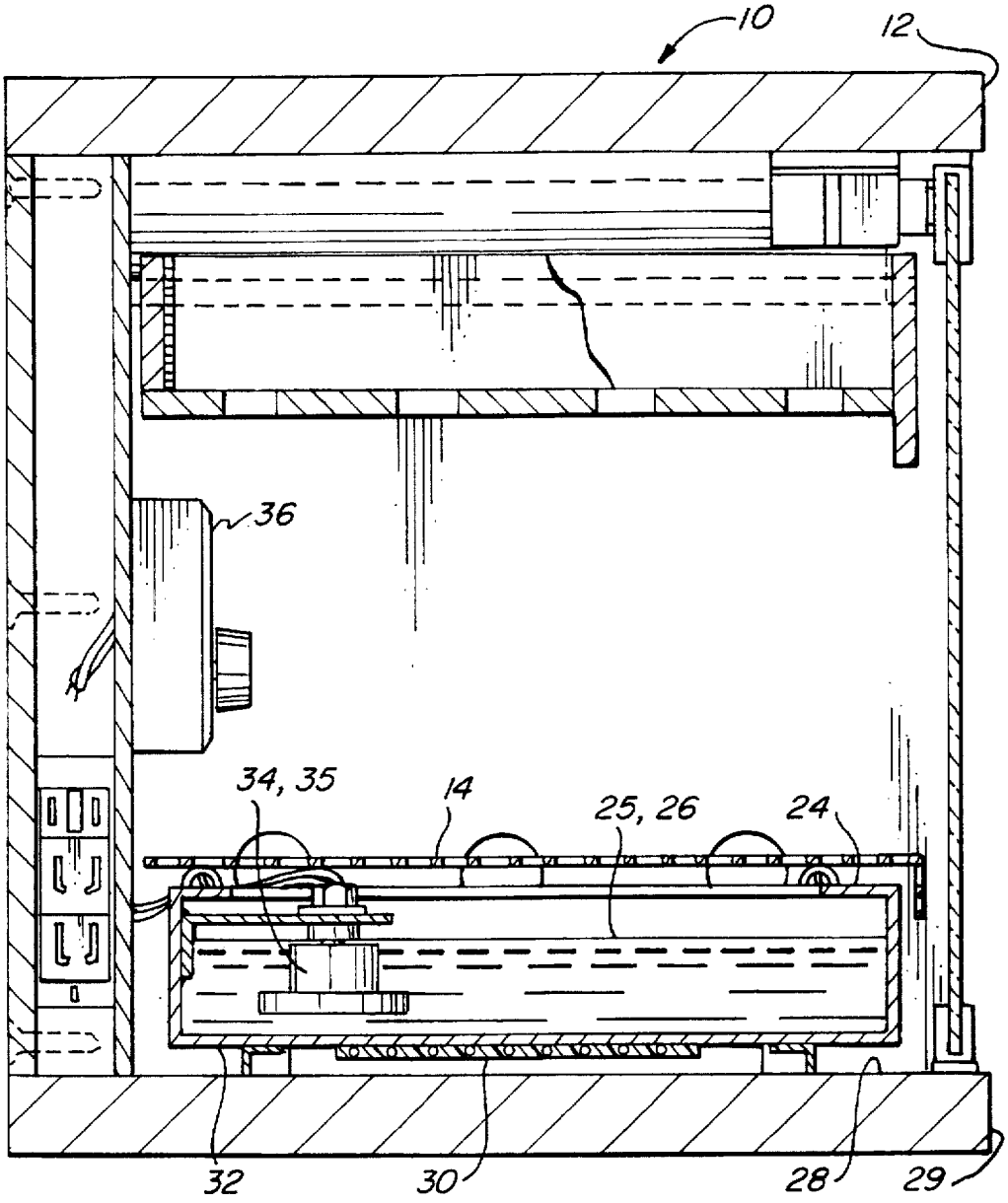
FIG. 3 is a side cross-sectional view of the humidor of FIG. 1 along line 3—3.

Referring to FIGS. 2 and 3, humidor 10 also includes a water reservoir 24 containing water 25 beneath shelf 14. Preferably, reservoir 24 has a large surface area 26 to enhance the evaporation rate of water 25 therefrom. Preferably, surface area 26 is greater than 50% of the surface area of the interior bottom surface 28 of the base 29 of humidor 10.

A heater 30 is attached to the underside 32 of reservoir 24 to increase the rate of evaporation of water therefrom. Preferably heater 30 includes a plurality of heating elements disposed substantially uniformly over a majority of the underside 32 of reservoir 24. Such a uniform distribution of the heating elements provides uniform heating of the water 25 in reservoir 24 and avoids hot spots thereby allowing the temperature of the water to be raised without significantly increasing the temperature within humidor 10. Humidor 10 may also include a water level sensor 34 such as the water level float switch 35 depicted. Humidor 10 may also include a humidity sensor 36 which may be adjustable.

When humidity sensor 36 detects that the humidity level within humidor 10 has dropped below a desired level (preferably selectable), heater 30 is energized to increase the temperature of water 25 in reservoir 24. Heater 30 slowly increases the temperature of water 25 to a few degrees F. over ambient temperature. Preferably, heater 30 gradually increases the temperature of the water at a rate of less than 5 degrees F. (e.g., 0.5 to 5) per 20 minutes. The increased temperature increases the rate of evaporation of water 25 thereby increasing the humidity level within humidor 10. When humidity sensor 36 detects that the desired humidity level has been reached, heater 30 is de-energized and water 25 cools to ambient temperature. The process is repeated when the humidity within humidor 10 again drops below the desired level.

Heater 30 need only raise the temperature of water 25 a few degrees F. over ambient temperature because of the large evaporative surface area 26 of reservoir 24. As mentioned above, preferably reservoir 14 has a surface area of greater than 50% of the surface are of interior bottom surface 28 of base 29 of humidor 10. Ideally, the surface area of reservoir 24 is between 70 and 80 percent of the surface area of the interior bottom surface 28 of base 29 of humidor 10. Preferably, heater 30 raises the temperature of the water 25 within reservoir 24 by less than 5 degrees F., and ideally only by 1 or 2 degrees F.

The small increase in temperature of the water 25 over a relatively large surface area is sufficient to increase the rate of evaporation of the water and thus increase the humidity within humidor 10, however it is not sufficient to significantly raise the temperature of the air within humidor 10. Also, the gradual heating of reservoir 24 helps to maximize the heat energy absorbed into reservoir 24 from heater 30 and thereby minimizes the heat energy lost into humidor 10. Moreover, the evaporation of water 25 from reservoir 24 has an inherent cooling effect which offsets any heat energy which does escape into humidor 10. Thus, reservoir 24, heater 30 and humidity sensor 36 effectively maintain a high level of humidity within humidor 10 without significantly affecting the temperature of the air inside.

Figure 4:
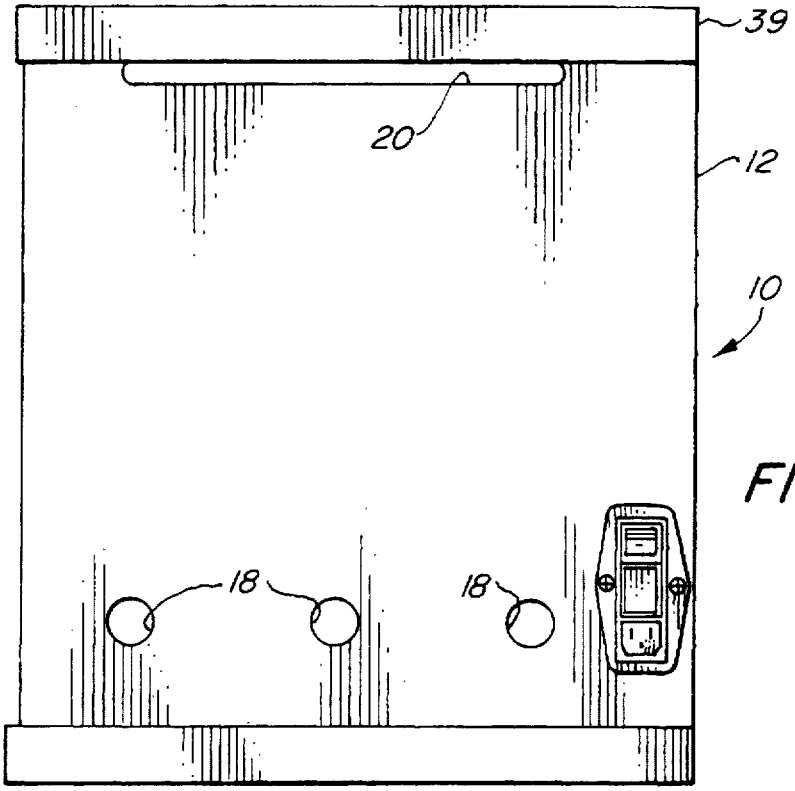
FIG. 4 is a side elevation view of the humidor of FIG. 1.
Figure 5:
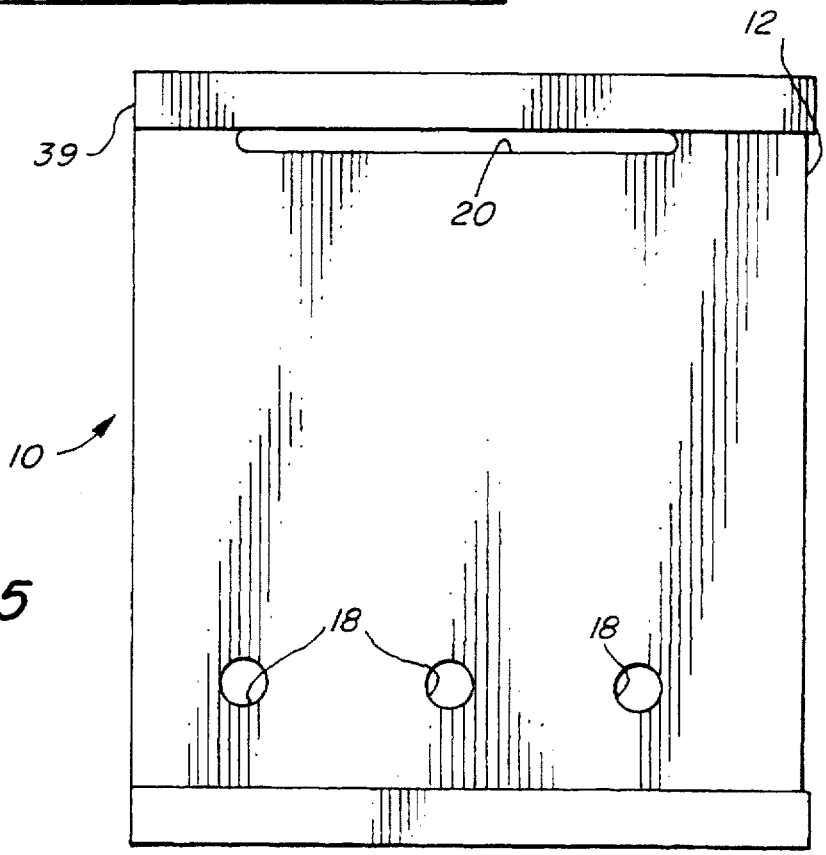
FIG. 5 is a side elevation view of the humidor of FIG. 1.

Referring to FIGS. 4 and 5, as mentioned above, humidor 10 may include air inlets 18 and outlet 20 for refreshing the air within humidor 10. Preferably, air outlets 20 are directly adjacent the top 39 of humidor 10.

Referring again to FIG. 2, humidor 10 may also include a plurality of convection heating elements 38 disposed adjacent air outlets 20 (not visible) and may also include shrouds 40 partially enclosing convection heating elements 38 and air outlets 20. Convection heating elements 38 (which are preferably incandescent lamps) serve to heat the air within shrouds 40. The heated air escapes through air outlets 20 drawing fresh air through air inlets 18. As mentioned above, preferably air outlets 20 are directly adjacent the top 39 of humidor 10. This enhances the flow of heated air therethrough.

Shrouds 40 serve two functions. First, they trap the air heated by convection heating elements 38 and direct the heated air through air outlets 20 thereby creating a convection current and preventing the heated air from dispersing within humidor 10. Second, shrouds 40 contain much of the heat radiated from convection heating elements 38 thereby minimizing the heat added to humidor 10.

Preferably, convection heating elements 38 are disposed uniformly along air outlets 20 (not visible) to promote an even flow of air, and preferably convection heating elements 38 generate heat such that the air within humidor is exchanged approximately 3 times per hour. The purpose of such air exchange being to prevent the commingling of aromas within humidor 10 and to prevent the air within humidor 10 from becoming stale.

Figure 6:
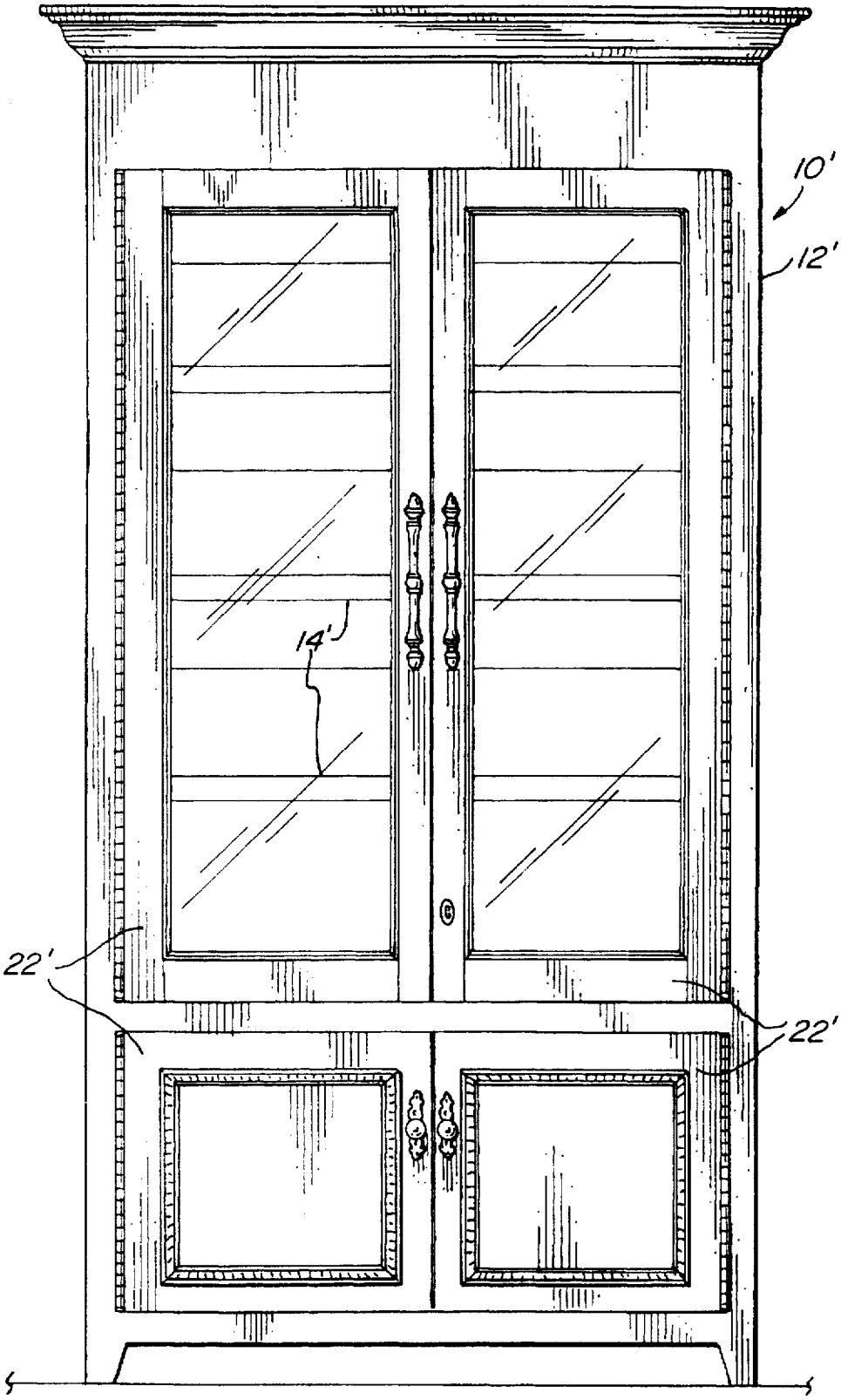
FIG. 6 is a front elevation view of a free-standing embodiment a humidor constructed in accordance with the present invention.
Figure 7:
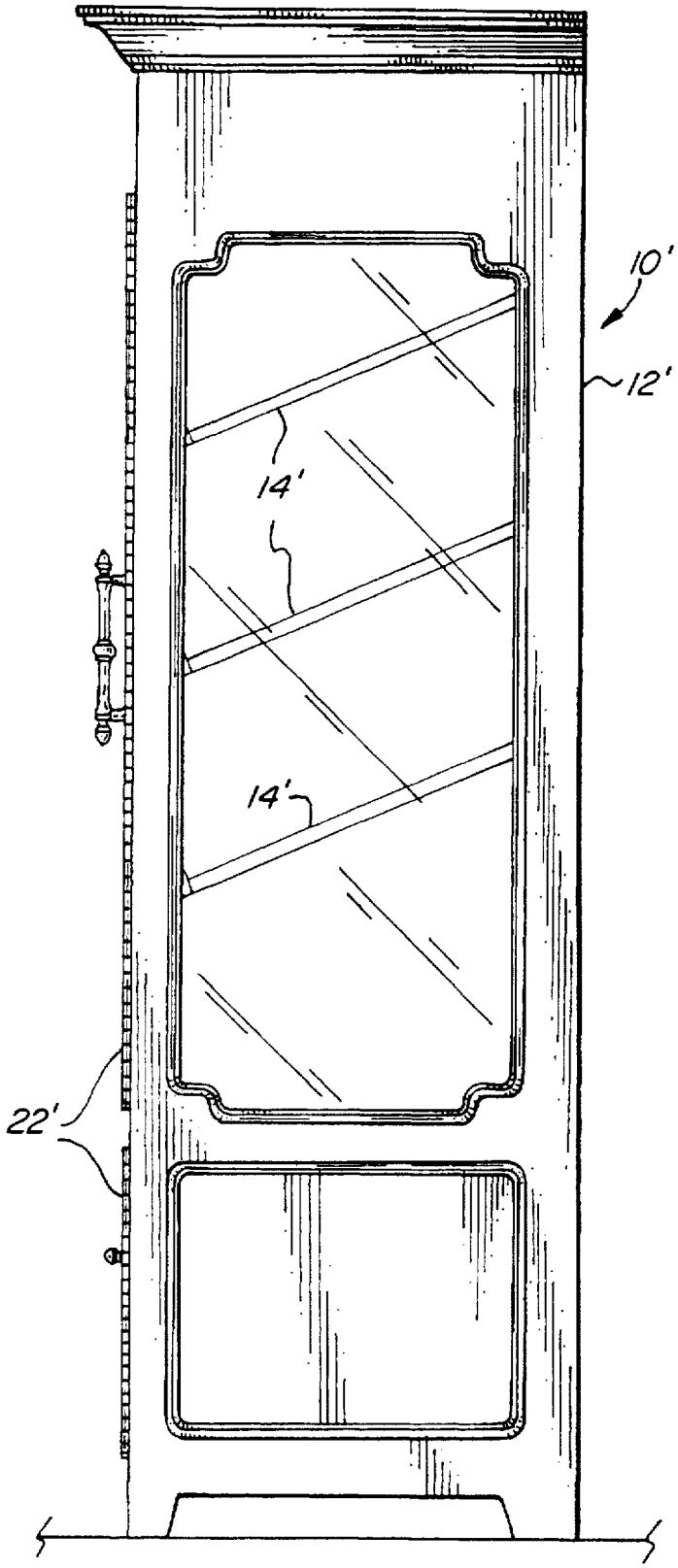
FIG. 7 is a side elevation view of the free-standing humidor of FIG. 6.
Figure 8:
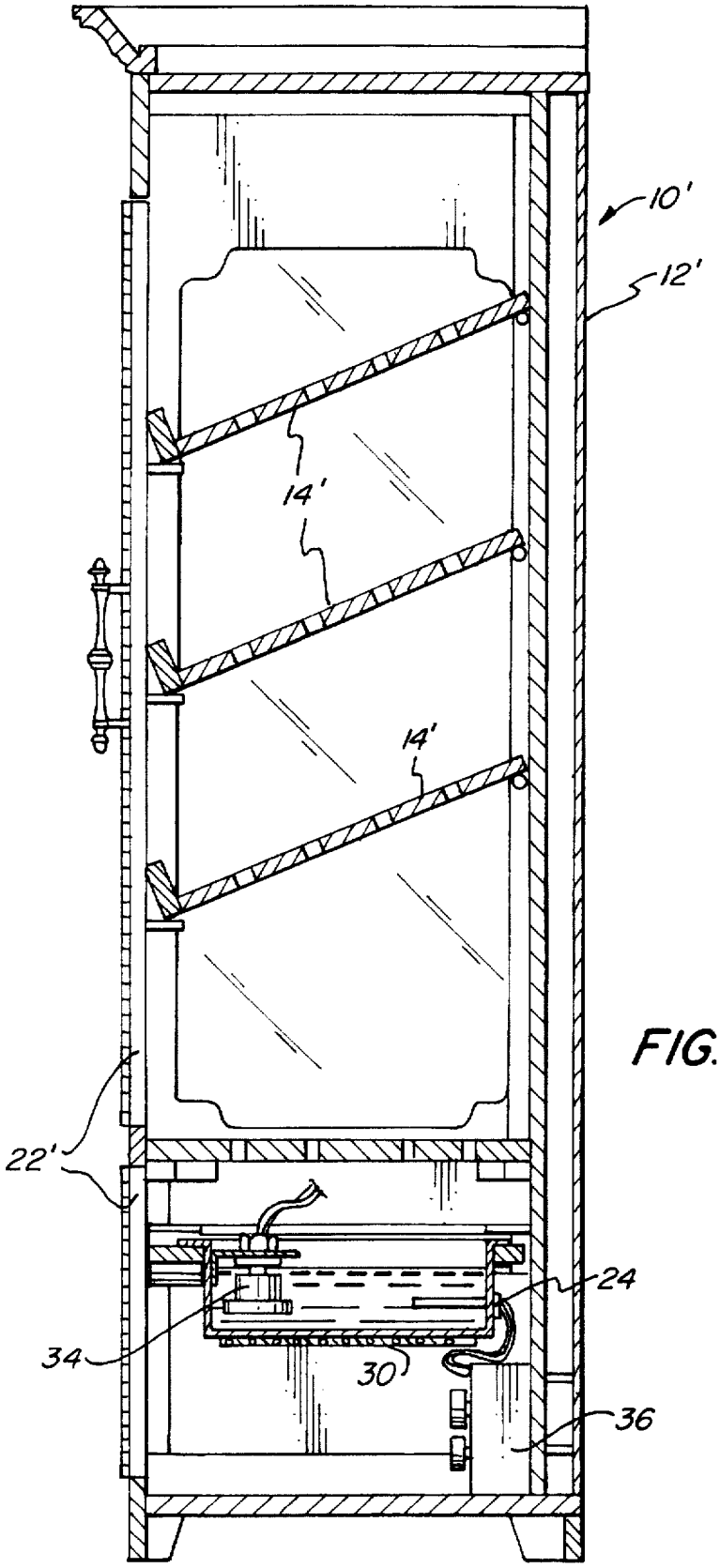
FIG. 8 is a side, cross-sectional view of the free-standing humidor of FIG. 6.

Referring to FIGS. 6, 7 and 8, humidor 10' of the present invention may consist of a free-standing enclosure 12' with a plurality of shelves 14' and doors 22' and with a reservoir 24, humidity sensor 36, heater 30, and water level sensor 34 disposed underneath the selves 14' as with the embodiments described above.

Figure 9:
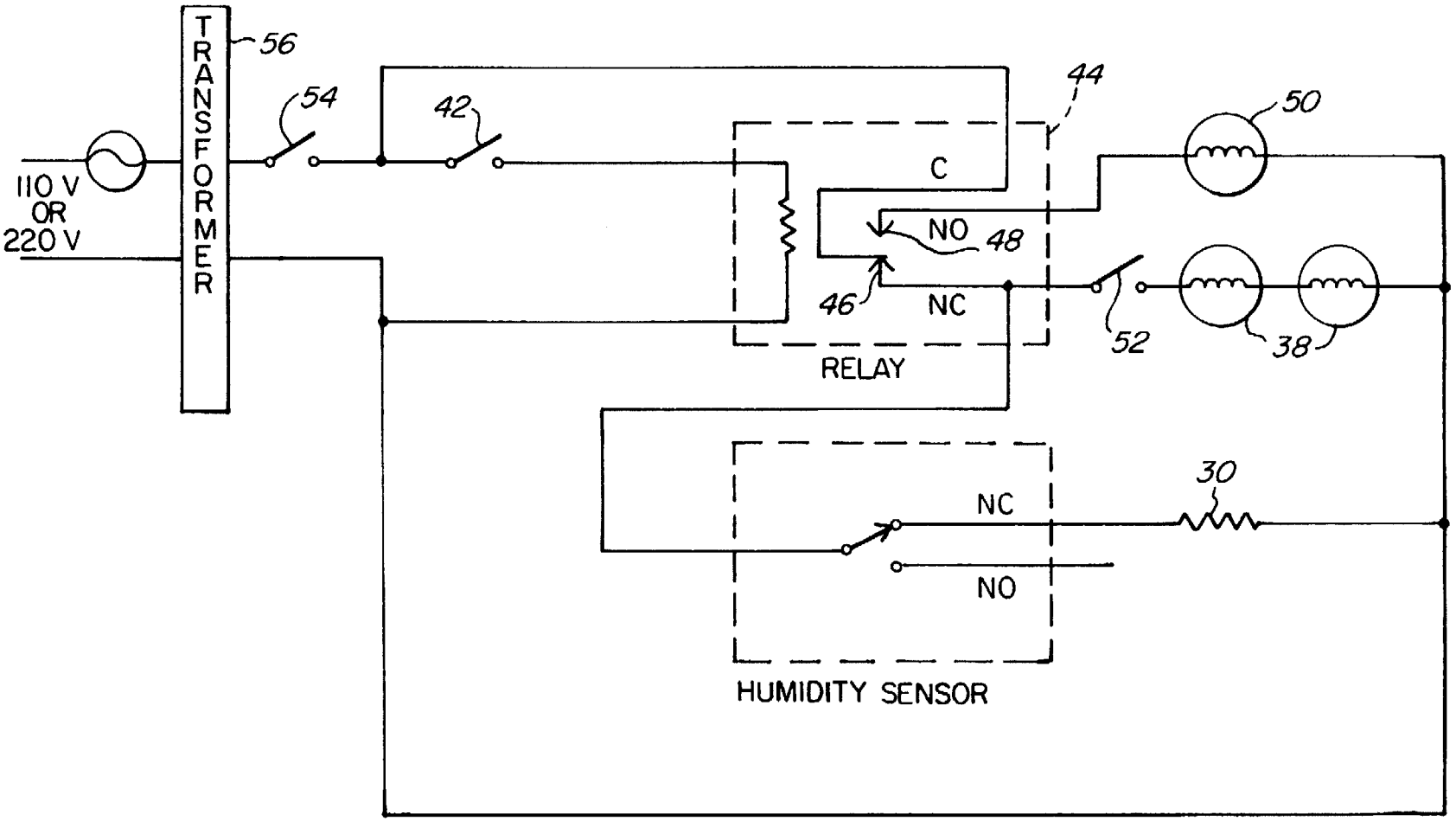
FIG. 9 is a schematic of the circuitry of the humidor of FIG. 1.

Referring to FIG. 9, water level sensor 42 controls a relay switch 44 which de-energizes the heater 30 and convection heating elements 38 when the water level drops below a minimum level. Relay switch 44 includes two poles 46, 48 one of which is normally closed 46 and a second which is normally open 48. Humidity sensor 36 and heater 30 are connected to one another in series and are in turn connected in parallel with convection heating elements 38 to normally closed pole 46 of relay switch 44. A water level low warning signal 50 (which may be visual or audible) is connected to the normally open pole 48.

Under normal operating conditions, the water level in the reservoir would be above the minimum level and the water level sensor would be in the open position (as shown). Relay switch 44 being inactivated would be in the normally closed position 46 (as shown). This activates the circuit containing humidity sensor 36 and heater 30 and the circuit containing convection heating elements 38. In this mode, convection heating elements 38 are continuously on and heater 30 is activated periodically as controlled by humidity sensor 36.

When the water level in the reservoir drops below a minimum level, water level sensor 42 closes thereby activating relay switch 44. This flips relay switch 44 to the normally open pole 48 thereby de-energizing heater 30 and convection heating elements 38 and energizing the water level low warning signal 50.

When shut down due to low water, ¼" of water remains. Since the ventilation is shut off the presence of the large surface area of water continues to evaporate and humidify the enclosure. Although humidity cannot get as high as with heater on, and flavors can mix because ventilation is off, the cigars are protected longer than if no humidification was present. This is designed to be a kind of emergency back-up system.

Also, humidor 10 may include a manual switch 52 to control the convection heating elements 38, a manual main on/off power switch 54, as wall as a transformer 56.

It will be appreciated that the above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention as defined in the appended claims.

What is claimed is:

1. A method for storing items at a high humidity level and at an ambient temperature comprising:

providing an enclosure around said items;

providing a water reservoir in said enclosure;

partially filling said water reservoir with water;

gradually heating said water reservoir to an elevated temperature of less than 5 degrees Fahrenheit above an ambient temperature to increase a rate of evaporation of said water;

maintaining said elevated temperature until a desired humidity level is reached;

ceasing heating said reservoir when said desired humidity level is reached thereby allowing said water to return to said ambient temperature; and repeating said heating and maintaining steps when said humidity level drops below said desired level.

2. The method of claim 1 wherein said enclosure further comprises a base with an interior bottom surface, said interior bottom surface having an area; wherein said water reservoir further comprises a surface area of at least 50% of said area of said interior bottom surface of said base; and wherein said step of gradually heating said water reservoir further comprises increasing a temperature of said water in said reservoir at a rate of less than 5 degrees Fahrenheit per 20 minutes.

3. The method of claim 2 wherein said reservoir further comprises an underside and wherein said step of gradually heating said reservoir further comprises attaching a heater to said under side of said reservoir, said heater having a plurality of heating elements disposed over a majority of said underside of said reservoir.

4. The method of claim 3 wherein said heating elements are disposed substantially uniformly over said majority of said underside of said reservoir.

5. The method of claim 4 further comprising providing a humidity sensor in said enclosure for periodically activating said heater when said humidity level drops below said desired level.

6. The method of claim 5 further comprising providing a water level sensor in said water reservoir, said water level sensor being connected to said heater for disconnecting said heater when a water level reaches a minimum level.

7. The method of claim 6 further comprising said water level sensor being connected to a water level low warning indicator for connecting said water level low warning indicator when said water level drops below said minimum level.

8. The method of claim 6 wherein said enclosure further comprises a top and a side; and further comprising:

providing at least one air inlet in said side;

providing at least one air outlet in said side between said top and said air inlet;

attaching at least one convection heating element to said enclosure adjacent said air outlet;

attaching a shroud to said enclosure above said air outlet and said convection heating element, said shroud extending downward from said enclosure to a point below and a position partially surrounding said convection heating element; and heating the air within said shroud with said convection heating element to induce a convection current from said inlets to said outlets.

9. The method of claim 8 wherein said enclosure further comprises two walls attached to said top; and further comprising:

providing a plurality of air inlets in each wall;

providing one elongated air outlet in each wall, said elongated air outlets being directly adjacent said top;

providing a plurality of convection heating elements attached to each wall directly below said air outlets, said convection heating elements being substantially uniformly distributed along said elongated air outlets;

providing shrouds attached to said top of said enclosure and extending downward therefrom to a point below and a position partially enclosing said convection heating element; and heating said air within said shrouds with said convection heating elements to induce convection currents from said inlets to said outlets.

10. The method of claim 9 wherein the step of providing a plurality of convection heating elements further comprises providing a plurality of incandescent lamps attached to said walls to simultaneously induce said convection currents and to illuminate said humidor.

11. The method of claim 10 wherein the step of providing a water level sensor in said water reservoir further comprises, said water level sensor being connected to said incandescent lamps for disconnecting said incandescent lamps when said water level reaches said minimum level.

12. The method of claim 11 further comprising said water level sensor being connected to a water level low warning indicator for connecting said water level low warning indicator when said water level drops below said minimum level.

13. The method of claim 1 wherein said enclosure further comprises a top and a side; and further comprising:

providing at least one air inlet in said side;

providing at least one air outlet in said side between said top and said air inlet;

attaching at least one convection heating element to said enclosure adjacent said air outlet;

attaching a shroud to said enclosure above said air outlet and said convection heating element, said shroud extending downward from said enclosure to a point below and to a position partially surrounding said convection heating element; and heating the air within said shroud with said convection heating element to induce a convection current from said inlet to said outlet.

14. The method of claim 13 wherein said enclosure further comprises two walls attached to said top; and further comprising:

providing a plurality of air inlets in each wall;

providing one elongated air outlet in each wall, said elongated air outlets being directly adjacent said top;

providing a plurality of convection heating elements attached to each wall directly below said air outlets, said convection heating elements being substantially uniformly distributed along said elongated air outlets;

providing shrouds attached to said top of said enclosure and extending downward therefrom to a point below and to a position partially enclosing said convection heating element; and heating said air within said shrouds with said convection heating elements to induce convection currents from said inlets to said outlets.

15. The method of claim 14 wherein the step of providing a plurality of convection heating elements further comprises providing a plurality of incandescent lamps attached to said walls to simultaneously induce said convection currents and to illuminate said humidor.

16. The method of claim 15 further comprising providing a water level sensor in said water reservoir, said water level sensor being connected to said incandescent lamps for disconnecting said incandescent lamps when a water level reaches a minimum level.

17. The method of claim 16 further comprising said water level sensor being connected to a water level low warning indicator for connecting said water level low warning indicator when said water level drops below said minimum level.

18. The method of claim 16 wherein said enclosure further comprises a base with an interior bottom surface, said interior bottom surface having an area; wherein said water reservoir further comprises a surface area of at least 50% of said area of said interior bottom surface of said base; and wherein said step of gradually heating said water reservoir further comprises increasing a temperature of said water in said reservoir at a rate of less than 5 degrees Fahrenheit per 20 minutes.

19. The method of claim 18 wherein said reservoir further comprises an underside and wherein said step of gradually heating said reservoir further comprises attaching a heater to said under side of said reservoir, said heater having a plurality of heating elements disposed over a majority of said underside of said reservoir.

20. The method of claim 19 wherein said heating elements are disposed substantially uniformly over said majority of said underside of said reservoir.

21. The method of claim 20 further comprising providing a humidity sensor in said enclosure for periodically activating said heater when said humidity level drops below said desired level.

22. The method of claim 21 wherein said step of providing a water level sensor in said water reservoir further comprises said water level sensor being connected to said heater for disconnecting said heater when said water level reaches said minimum level.

23. The method of claim 22 further comprising said water level sensor being connected to a water level low warning indicator for connecting said water level low warning indicator when said water level drops below said minimum level.

* * * * *